US005888157A

United States Patent [19]

Guenther et al.

[11] Patent Number: 5,888,157

[45] Date of Patent: Mar. 30, 1999

[54] FOOTBALL

[75] Inventors: Douglas G. Guenther, Carol Stream; Bradley Lee Gaff, Naperville, both of Ill.

[73] Assignee: Wilson Sporting Goods Co., Chicago, Ill.

[21] Appl. No.: 943,783

[22] Filed: Oct. 3, 1997

[51] Int. Cl.[6] ..... A63B 41/00

[52] U.S. Cl. ..... 473/604; 473/605

[58] Field of Search ..... 473/597, 598, 473/599, 601, 602, 603, 604, 605, 607, 608, 609

[56] References Cited

U.S. PATENT DOCUMENTS

| | | | |
|---|---|---|---|
| 2,214,179 | 9/1940 | Reach | 473/604 |
| 2,280,314 | 4/1942 | Scudder | 473/604 |
| 2,627,892 | 2/1953 | Fenton | 473/605 |
| 2,653,818 | 9/1953 | Tebbetts, Jr. et al. | 473/604 |
| 3,119,618 | 1/1964 | Molitor et al. | 473/599 |
| 3,506,265 | 4/1970 | Yugi . | |
| 3,863,923 | 2/1975 | Anderson . | |
| 3,948,518 | 4/1976 | Tebbetts, Jr. | 473/605 |
| 4,187,134 | 2/1980 | Svub et al. . | |
| 5,542,662 | 8/1996 | Kouzai et al. . | |
| 5,636,835 | 6/1997 | Schindler et al. | 473/605 |
| 5,681,233 | 10/1997 | Guenther et al. | 473/605 |

*Primary Examiner*—Steven Wong

[57] ABSTRACT

A football includes an elongated bladder and a plurality of longitudinally extending rubber strips which are secured to the bladder. Each of the rubber strips has a longitudinally extending groove. A plurality of cover panels surround the bladder and the rubber strips. Each of the cover panels has a pair of longitudinally extending tapered edges which extend into grooves in the rubber strips and which abut against edges of adjacent cover panels.

5 Claims, 2 Drawing Sheets

FOOTBALL

BACKGROUND

This invention relates to footballs, and, more particularly, to a football which simulates a football with a sewn leather cover.

The invention is an improvement over U.S. Pat. No. 3,948,518. As described in that patent, footballs with sewn leather covers have a shape and feel which are preferred by many players for official competition. However, such footballs are expensive, and buyers of footballs often choose to purchase footballs with rubber or synthetic covers which are not sewn.

The '518 patent describes an attempt to make a football with a non-sewn cover which simulates the shape and feel of a sewn leather football. However, the football of the '518 patent has cover panels which are spaced apart and which expose simulated seams. The simulated seams are provided by raised portions on side panels underneath the cover panels. The simulated seams do not have the appearance or feel of the seams of a traditional sewn leather football.

SUMMARY OF THE INVENTION

The invention provides a football with a non-sewn cover having seams which simulate the appearance and feel of seams of a sewn leather cover. A rubber strip is attached to a bladder below each seam. Each rubber strip has a groove below the seam. Cover panels with tapered edges are attached to the bladder, and tapered edges of adjacent cover panels extend into a groove and butt together.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
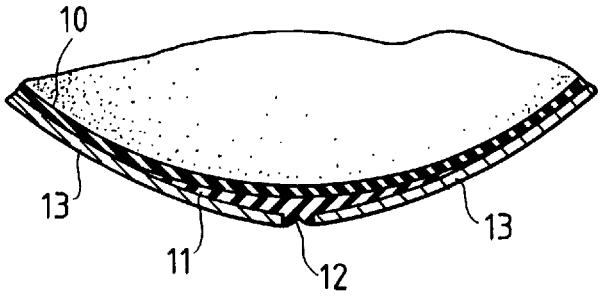
FIG. 1 PRIOR ART
FIG. 1 illustrates the prior art football of U.S. Pat. No. 3,948,518.

FIG. 1 is a reproduction of FIG. 10 of U.S. Pat. No. 3,948,518. The football described in that patent includes a wound bladder 10 and four side panels 11. Each side panel includes a raised seam portion 12 which projects between adjacent cover panels 13.

Figure 2:
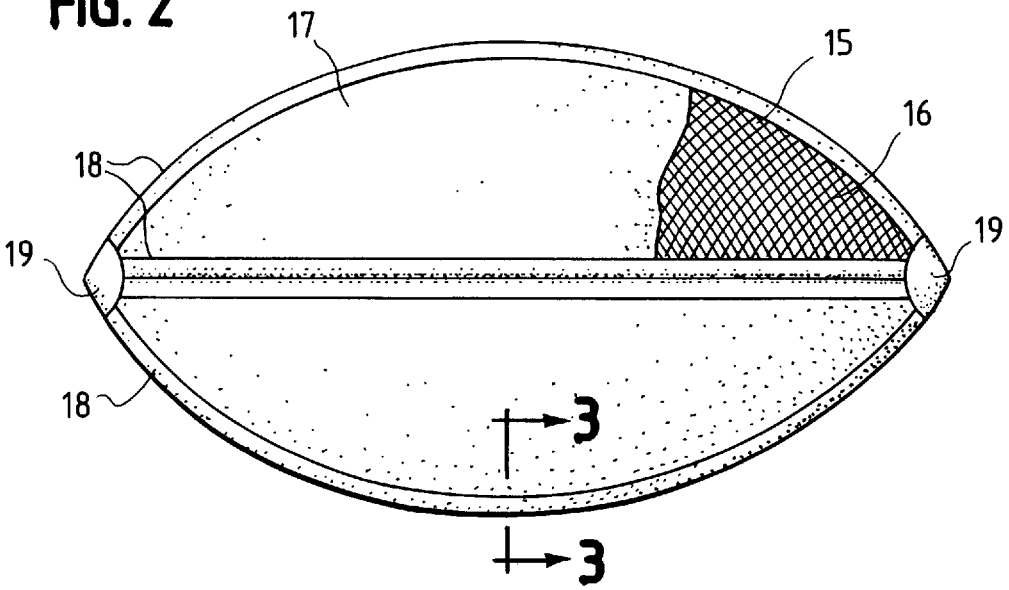
FIG. 2 illustrates a bladder, rubber cover panels, and rubber strips of the football of the invention.

FIG. 2 illustrates a wound bladder 15 which can be similar to the wound bladder of the '518 patent. The rubber bladder has the elongated ellipsoidal shape of a football when inflated, and the bladder is covered with a layer of windings 16 of nylon or polyester thread. The thread is dipped in or coated with latex adhesive or solvent based adhesive before being wound over the bladder.

The wound bladder is completely covered by a plurality of panels 17 of thin rubber. Several panels of rubber are placed in the bottom part of a two-part mold, the wound bladder is placed in the bottom part of the mold over the panels, the top of the bladder is covered with additional panels of rubber, and the top part of the mold is closed to force the rubber panels against the wound bladder and the adhesive coated windings and adhesively secure the rubber panels to the bladder.

Figure 3:
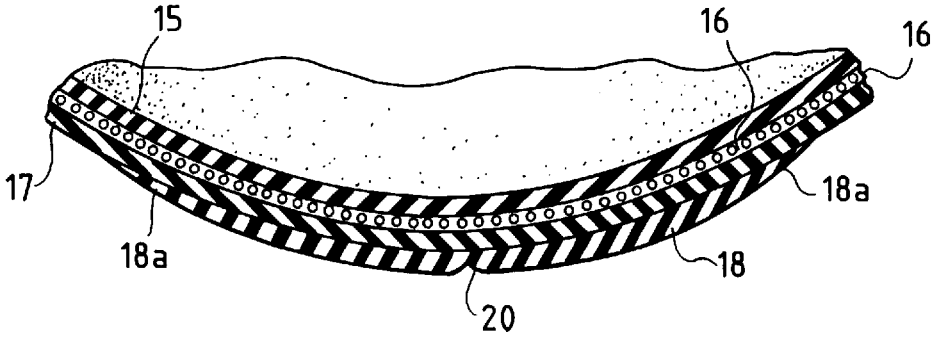
FIG. 3 is an enlarged fragmentary sectional view taken along the line 3—3 of FIG. 2.

Four elongated rubber seam strips 18 are then glued onto the rubber-covered wound bladder. The rubber strips extend longitudinally and are spaced 90° apart around the circular cross section of the bladder. Each strip is about one inch wide and includes tapered longitudinal side edges 18*a* (FIG. 3). Two rubber end pieces 19 are glued onto the ends of the rubber-covered bladder. The inflated bladder with the rubber cover panels, rubber strips, and rubber end pieces is placed in a football-shaped mold, and the rubber pieces are fused to the wound bladder and to each other under heat and pressure to vulcanize the rubber and form the carcass of the football. The mold also forms an elongated V-shaped groove 20 (FIG. 3) in each of the rubber seam strips and two grooves in the end pieces which are continuations of the grooves 20.

FIG. 3 illustrates the vulcanized bladder 15, rubber cover panels 17, and rubber seam strips 18 as separate layers for clarity of illustration. It will be understood, however, that the rubber layers fuse together.

Figure 4:
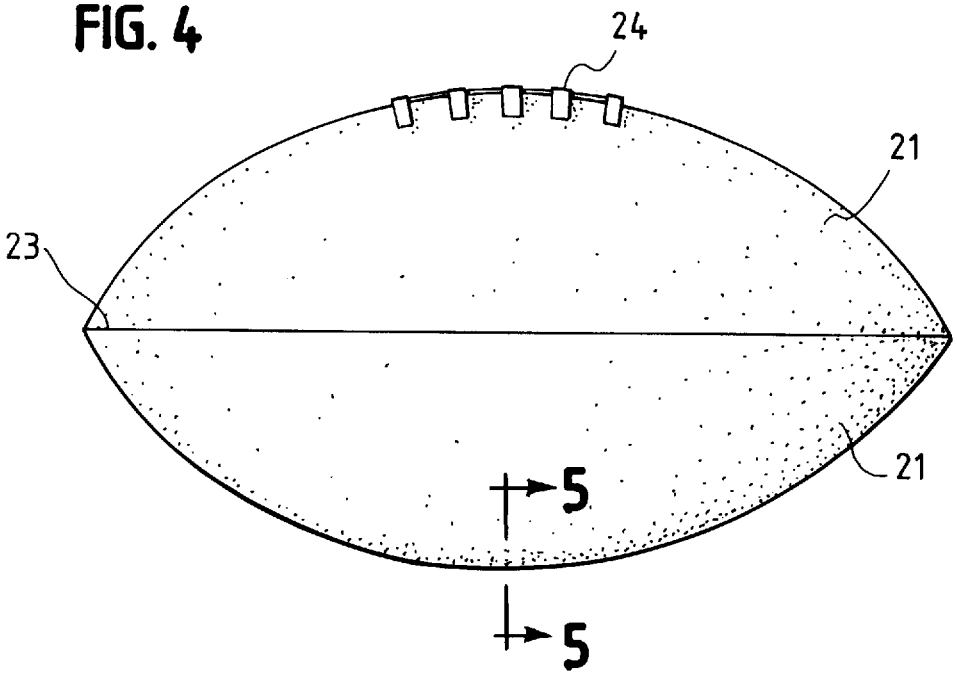
FIG. 4 illustrates a football formed in accordance with the invention.

Four outer cover panels 21 (FIG. 4) are then adhesively attached to the carcass. The outer cover panels can be formed from any desired material, for example, leather, synthetic leather, rubber, etc. In one specific embodiment the outer cover panels were formed from urethane coated microfiber synthetic leather.

Figure 5:
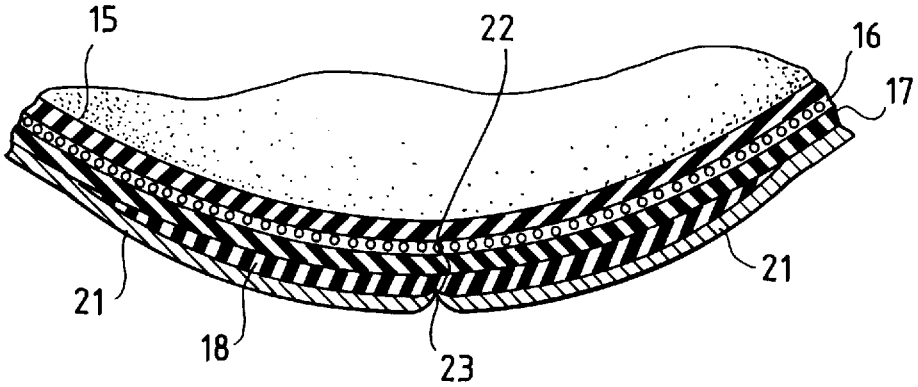
FIG. 5 is an enlarged fragmentary sectional view taken along the line 5—5 of FIG. 4.

Referring to FIG. 5, each outer cover panel has a pair of longitudinally extending side edges 22 which are tapered or skived by a conventional cutting machine which cuts and skives the panels. Such machines have been used to cut and skive cover panels for basketballs. Each of the tapered edges of each cover panel extends into one-half of one of the V-shaped grooves 20 in a seam strip 18 and butts against the tapered edge of an adjacent cover panel. The abutting tapered edges form a butt joint which completely covers the rubber seam strip 18 and does not leave any portion of the seam strip exposed.

The combination of the tapered edges and the grooves in the rubber seam strips form four longitudinally extending indentations 23 in the cover which simulate the appearance and feel of the seams of a sewn leather-covered football. In a sewn leather-covered football the cover panels are sewn together in an inside-out configuration, and the sewn cover is then inverted so that the sewing is on the inside. The seams are formed by inwardly curved edge portions of adjacent cover panels. The rubber seam strips 18 and end pieces 19 underneath the outer cover give the ball the weight and feel of a traditional sewn ball.

The football may be completed by lacing 24 which is laced through openings in two of the cover panels. The cover panels are not glued to the carcass in the area of the lacing to permit the panels to be laced. A piece of backing cloth is attached to the underside of the cover to improve the tear strength of the cover so that the cover does not deform or stretch during lacing.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. A football comprising:

an ellipsoid shaped bladder having a longitudinal axis and a generally circular transverse cross section, a plurality of rubber strips secured to the bladder and extending in a longitudinal direction, each of the rubber strips having an outer surface, a pair of longitudinally extending side edges, and a longitudinally extending V-shaped groove which extends generally parallel to the side edges, and a cover surrounding the bladder and the rubber strips, the cover being formed by a plurality of cover panels which are secured to the bladder, each cover panel having outer and inner surfaces and a pair of longitudinally extending tapered edges which taper downwardly from the outer surface to the inner surface, the tapered edges of each cover panel extending downwardly into a V-shaped groove of a rubber strip and abutting tapered edges of adjacent cover panels to form V-shaped indentations in the cover.

2. The football of claim 1 in which said rubber strips are spaced about 90° apart around the circular cross section of the bladder.

3. The football of claim 2 in which the longitudinal side edges of each of the rubber strips are tapered downwardly from the outer surface thereof.

4. A method of making a football comprising the steps of:

forming an ellipsoid shaped bladder having a longitudinal axis and a generally circular transverse cross section, securing a plurality of rubber strips to the bladder so that the bladder extends in a longitudinal direction, molding the bladder and the rubber strips to form a carcass, the mold forming a generally V-shaped groove in each of the strips, securing a plurality of cover panels to the bladder, each cover panel having outer and inner surfaces and a pair of longitudinally extending tapered edges which taper inwardly from the outer surface to the inner surface, and positioning each of the tapered edges of each panel in one of said V-shaped grooves so that each tapered edge of a panel abuts a tapered edge of an adjacent panel.

5. The method of claim 4 in which said rubber strips are secured to the bladder at locations which are spaced about 90° apart around the circular cross section of the bladder.

* * * * *